US006871469B2

(12) United States Patent
Lissandre et al.

(10) Patent No.: US 6,871,469 B2
(45) Date of Patent: Mar. 29, 2005

(54) TRIANGULATION OF A LATTICE GIRDER, IN PARTICULAR OF A JIB ELEMENT FOR A TOWER CRANE

(75) Inventors: Michel Lissandre, Yzeure (FR); Jean-Pierre Gautier, Avermes (FR)

(73) Assignee: Potain, Ecully (FR)

( * ) Notice: Subject to any disclaimer, the term of this patent is extended or adjusted under 35 U.S.C. 154(b) by 5 days.

(21) Appl. No.: 10/387,517

(22) Filed: Mar. 14, 2003

(65) Prior Publication Data

US 2003/0226330 A1 Dec. 11, 2003

(30) Foreign Application Priority Data

Apr. 16, 2002 (FR) ..... 02 04738

(51) Int. Cl.[7] ..... E04C 3/02

(52) U.S. Cl. ..... 52/633; 52/634; 52/636; 52/637; 52/648.1; 52/651.01; 52/650.1; 52/650.2; 52/693; 212/347

(58) Field of Search ..... 52/633, 634, 636, 52/637, 648.1, 651.01, 650.1, 650.2, 690, 693, 653.1, 653.2; 212/347

(56) References Cited

U.S. PATENT DOCUMENTS

| | | | | | |
|---|---|---|---|---|---|
| 791,975 | A | * | 6/1905 | Allen | 52/292 |
| 1,141,967 | A | * | 6/1915 | Lacoste | 52/82 |
| 1,698,849 | A | * | 1/1929 | Leisy | 52/653.1 |
| 2,019,810 | A | * | 11/1935 | Deuel | 52/653.1 |
| 3,021,014 | A | | 2/1962 | Korensky et al. | |
| 3,330,201 | A | * | 7/1967 | Mouton, Jr. | 52/81.2 |
| 4,173,102 | A | * | 11/1979 | Judge | 52/73 |
| 4,414,787 | A | * | 11/1983 | Kappen | 52/643 |
| 4,642,830 | A | * | 2/1987 | Richard | 14/4 |
| 4,689,932 | A | * | 9/1987 | Zeigler | 52/653.1 |
| 4,715,160 | A | * | 12/1987 | Romanelli | 52/653.1 |
| RE33,710 | E | * | 10/1991 | Zeigler | 52/648 |
| 5,105,589 | A | * | 4/1992 | Rodriguez | 52/79.1 |
| 5,505,035 | A | * | 4/1996 | Lalvani | 52/648.1 |
| 5,711,131 | A | * | 1/1998 | Thomas | 52/656.9 |
| 5,956,915 | A | * | 9/1999 | Piper et al. | 52/651.05 |
| 6,065,267 | A | * | 5/2000 | Fisher | 52/692 |
| 6,378,260 | B1 | * | 4/2002 | Williamson et al. | 52/426 |
| 6,708,455 | B1 | * | 3/2004 | Niiduma | 52/81.2 |

FOREIGN PATENT DOCUMENTS

| | | |
|---|---|---|
| EP | 0 928 769 A | 7/1999 |
| FR | 2 049 423 A | 3/1971 |
| FR | 2 280 754 A | 2/1976 |
| FR | 2 773 550 | 7/1999 |

* cited by examiner

*Primary Examiner*—Jeanette E. Chapman
(74) *Attorney, Agent, or Firm*—Oliff & Berridge, PLC

(57) ABSTRACT

For a lateral face of the lattice girder, defined by an upper chord and a lower chord, the triangulation comprises compression bars substantially perpendicular to the chords, oblique tension bars of smaller length connecting the top of a compression bar to the lower chord, and other oblique tension bars of greater length, also connecting the top of a compression bar to the lower chord, at a point located further ahead toward the base of the next compression bar. This triangulation is used, in particular, for the jib and counterjib elements of tower cranes.

9 Claims, 3 Drawing Sheets

TRIANGULATION OF A LATTICE GIRDER, IN PARTICULAR OF A JIB ELEMENT FOR A TOWER CRANE

BACKGROUND OF THE INVENTION

The present invention relates to a triangulation of a lattice girder, in particular of a cantilever girder. Even more particularly, this invention relates to the triangulation of a lattice jib element, or of a lattice counterjib element, of a tower crane.

DESCRIPTION OF THE PRIOR ART

In a generally known way, a tower crane jib, along which a jib carriage is usually displaced, consists of a succession of jib elements aligned and assembled with one another so as to form a jib having the desired length. Each jib element is a structure of the lattice girder type, with a triangular, rectangular or trapezoidal cross section, which comprises chords which two by two define plane faces. In each of these plane faces, the two chords are connected to one another by means of elongate parts of the bar type which together form what is called a "triangulation". This type of structure is also used for the counterjibs of tower cranes which support a counterweight balancing the jib and, if appropriate, the raised load.

The particular feature of this type of lattice girder is that, with regard to its lateral faces, it possesses an always tensioned upper chord and an always compressed lower chord when the girder is working.

The triangulation configuration which is the mast common at the present time for the jib elements of tower cranes is that illustrated in FIG. 1 of the accompanying diagrammatic drawing which illustrates a jib element portion in perspective. This being a jib element of triangular cross section, its single upper chord is indicated at 2, while its two lower chords are indicated at 3.

The triangulation comprises, repeated in the longitudinal direction at an interval P and in each lateral face of the jib element in question:

- bars 4 and 5 perpendicular to the chords 2 and 3 and each connecting the upper chord 2 to one of the lower chords 3;
- other bars 6 and 7 extending obliquely, each oblique bar, called a "diagonal", connecting the top of one of the preceding bars 4 or 5 to the base of the next one of these bars.

The horizontal lower face of the jib element possesses a different structure, with cross members 8, 9, 10 and alternate diagonal bars 11, 12.

As an example of such a known triangulation for a jib element, reference is made to patent application FR 2773550 A in the Applicant's name or to its equivalent, the document EP 0928769 A.

Still referring to FIG. 1, considering the forces in the bars of the lateral triangulations in terms of two consecutive intervals P, these forces are as follows, whatever the value of the load raised by the crane or the position of the load:

for the bars 4 and 5: compressive forces;

for the other bars 6 and 7: tensile forces.

Consequently, the lengths of the bars 4 and 5 must be as small as possible, to prevent their buckling due to compression. The length of the other bars 6 and 7 may be greater.

The main disadvantage of this type of triangulation is that it is not optimal in terms of dimensioning other than, in particular, the corresponding structure still has a relatively high weight.

SUMMARY OF THE INVENTION

The present invention is aimed at eliminating these disadvantages, hence at optimizing the construction of a lattice girder element, more particularly of a jib element or counterjib element for a tower crane, by reducing the number of component parts of the element, by thus reducing the weight of this element and by also reducing its wind-resistant lateral surface, hence by reducing its manufacturing cost and the cost of operating the crane.

To this effect, the subject of the invention is a triangulation of a lattice girder, in particular of a lattice jib element, or of a lattice counterjib element, of a tower crane, this triangulation comprising, for a lateral face of said girder or of said lattice element defined by an upper chord and a lower chord and divided longitudinally according to a predefined interval P:

- compression bars substantially perpendicular to the chords and each connecting the upper chord to the lower chord, these compression bars succeeding one another according to a spacing equal to double the interval P;
- oblique tension bars of smaller length, each connecting the top of a compression bar to the lower chord at a point located at an interval P ahead of the base of this compression bar;
- other oblique tension bars of greater length, each connecting the top of a compression bar to the lower chord at a point located at two intervals P ahead of the base of this compression bar, hence at the base of the next compression bar.

The triangulation which is the subject of the invention is thus characterized by a combination of more spaced-apart and therefore less numerous compression bars and of "diagonals" of two types, some shorter and the others longer. It will also be noted that this structure is characterized by special assembly nodes in the region of the upper chord, each of these nodes being substantially the point of convergence of a compression bar, of a "short" oblique bar and of a "long" oblique bar The compression bars ensure the absorption of main forces. The "long" oblique tension bars also have a function of the absorption of main forces As regards the "short" oblique tension bars, these have special functions of the absorption of the vertical forces attributable to the passage of the carriage and the counter buckling of the lower chord.

All these bars, whether they be compression bars or "short" and "long" oblique tension bars, are produced preferably in the form of tubes of circular or oval cross section, with flattened and cut ends for producing the assembly nodes. In particular, to produce the upper assembly nodes which form points of convergence for the three types of triangular bars, there is advantageously provision:

- for the compression bars to comprise a flattened and cut upper end, with a rectilinear upper edge parallel to the longitudinal axis of the upper chord, and welded to this chord;
- for the oblique tension bars of greater length to comprise a flattened and cut upper end, with a rectilinear upper edge parallel to the longitudinal axis of the upper chord, and welded to this chord, the flattened upper end of these bars also possessing a substantially vertical rear edge coming up against a corresponding front edge of the flattened upper end of a compression bar, and these two adjacent edges being welded to one another;
- for the oblique tension bars of smaller length to comprise a flattened and cut upper end which straddles the adjacent flattened upper ends of a compression bar and of an oblique tension bar of greater length, the perimeter of the flattened upper end of each oblique tension bar of smaller length being welded to the flattened upper ends of the other bars which it straddles.

According to a particular embodiment of this triangulation, the respective neutral fibers of the compression bars and of the oblique tension bars of greater length are concurrent with one another at points located in a horizontal plane containing the neutral fiber of the upper chord.

With regard to a girder or a jib element of triangular cross section, the respective neutral fibers of the compression bars and of the oblique tension bars of greater length, belonging to the two lateral faces, are all concurrent with one another at points located in the vertical plane containing the neutral fiber of the upper chord.

Still with regard to a jib element of triangular cross section, the respective neutral fibers of the oblique tension bars of smaller length, belonging to the two lateral faces, are themselves concurrent with one another at points located in the vertical plane containing the neutral fiber of the upper chord.

Overall, a lateral triangulation of a jib element for a tower crane is thus obtained, which affords:

- a reduction in the number of component parts for the manufacture of the jib element;
- a saving in terms of the weight of this jib element, itself bringing about a reduction in the ballast of the counterjib and of the actual structure of the counterjib;
- a reduction in the wind-resistant lateral surface for the jib element, itself bringing about a reduction in the wind-compensating surface for the counterjib.

These advantages, taken as a whole, give rise, in turn, to an appreciable economic saving, both in the manufacture of the jib elements and of the crane and in the operation of this crane, more particularly during its installation on sites.

BRIEF DESCRIPTION OF THE DRAWINGS

The invention will be understood more clearly from the following description, with reference to the accompanying diagrammatic drawing which illustrates, by way of nonlimiting example, an embodiment of this triangulation applied to a jib element for a tower crane and in which:

FIG. 1 recalls the principle of a known triangulation on a portion of a jib element of a tower crane. In addition, FIG. 2 shows the complete jib element, designated by 13, produced with this triangulation which is repeated according to the interval P over the entire length of the jib element 13. Being a side view, this FIG. 2 shows more particularly the lateral triangulation of the jib element 13, with its substantially vertical bars and its oblique bars.

By way of comparison, FIG. 3 shows a jib element 13 produced, with regard to its two lateral faces, with a triangulation according to the invention, also illustrated in perspective (for a portion of this jib element) in FIG. 4.

Figure 1:
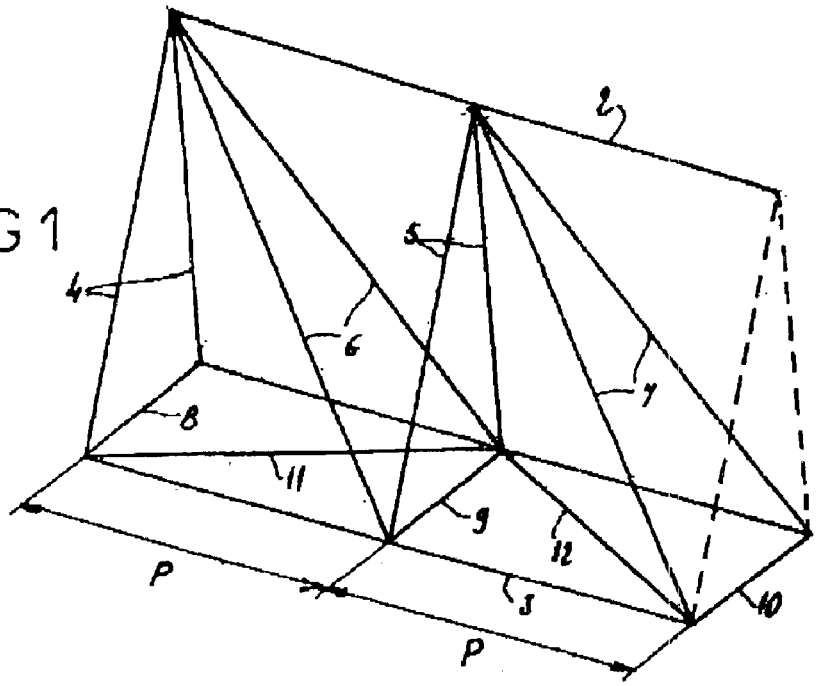
FIG. 1 (already mentioned) is a perspective view of a jib element portion with triangulation according to the prior art.
Figure 2:
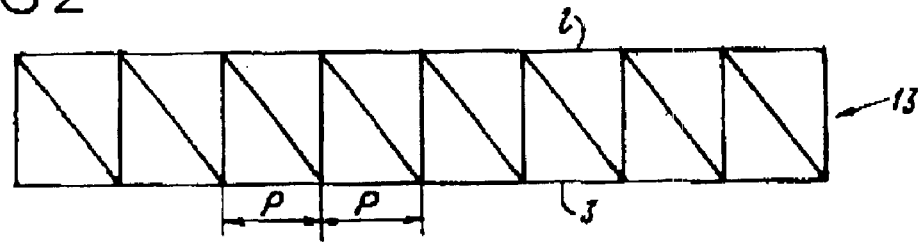
FIG. 2 is a side view of the jib element with this triangulation of the prior art.
Figure 3:
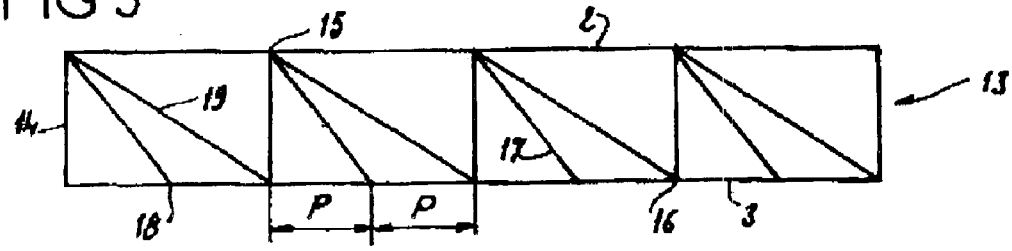
FIG. 3 is a side view of a jib element with triangulation according to the invention.
Figure 4:
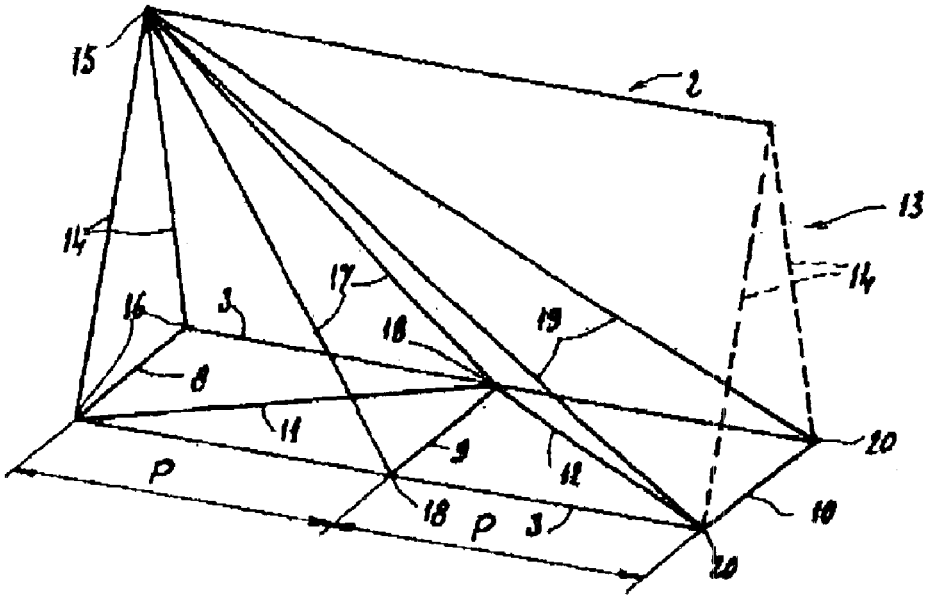
FIG. 4 is a perspective view of a jib element portion with triangulation according to the invention.

Being a jib element 13 of triangular cross section, the triangulation considered here more particularly is that of one or other of the two lateral faces defined by the upper chord 2 and by one of the two lower chords 3.

The lateral triangulation comprises substantially vertical compression bars 14 which each connect a point 15 of the upper chord to a point 16 of the lower chord 3. The compression bars 14 succeed one another according to a regular spacing 2P equal to double the predefined interval P.

The lateral triangulation also comprises oblique tension bars 17 which each connect the top 15 of a compression bar 14 to a point 18 of the lower chord 3, the point 18 being located at one interval P ahead of the base 16 of this same compression bar 14.

Finally, the triangulation comprises other oblique tension bars 19 of a greater length than the preceding ones. Each tension bar 19 connects the top 15 of a compression bar 14 to a point 20 of the lower chord 3, said point being located at two intervals P ahead of the base 16 of this same compression bar 14, hence at the base of the next compression bar 14.

It may be gathered from the foregoing description that the top 15 of each compression bar 14 forms an upper assembly node where a compression bar 14, an oblique tension bar 17 of smaller length and an oblique tension bar 19 of greater length converge (for one lateral face of the jib element 13), and where these three bars 14, 17, 19 are also connected directly or indirectly to the upper chord 2.

As regards the horizontal lower face of the jib element 13, this is still produced in the conventional way, with cross-members 8, 9, 10 spaced apart regularly according to the interval P and with alternate diagonal bars 11, 12.

Figure 5:
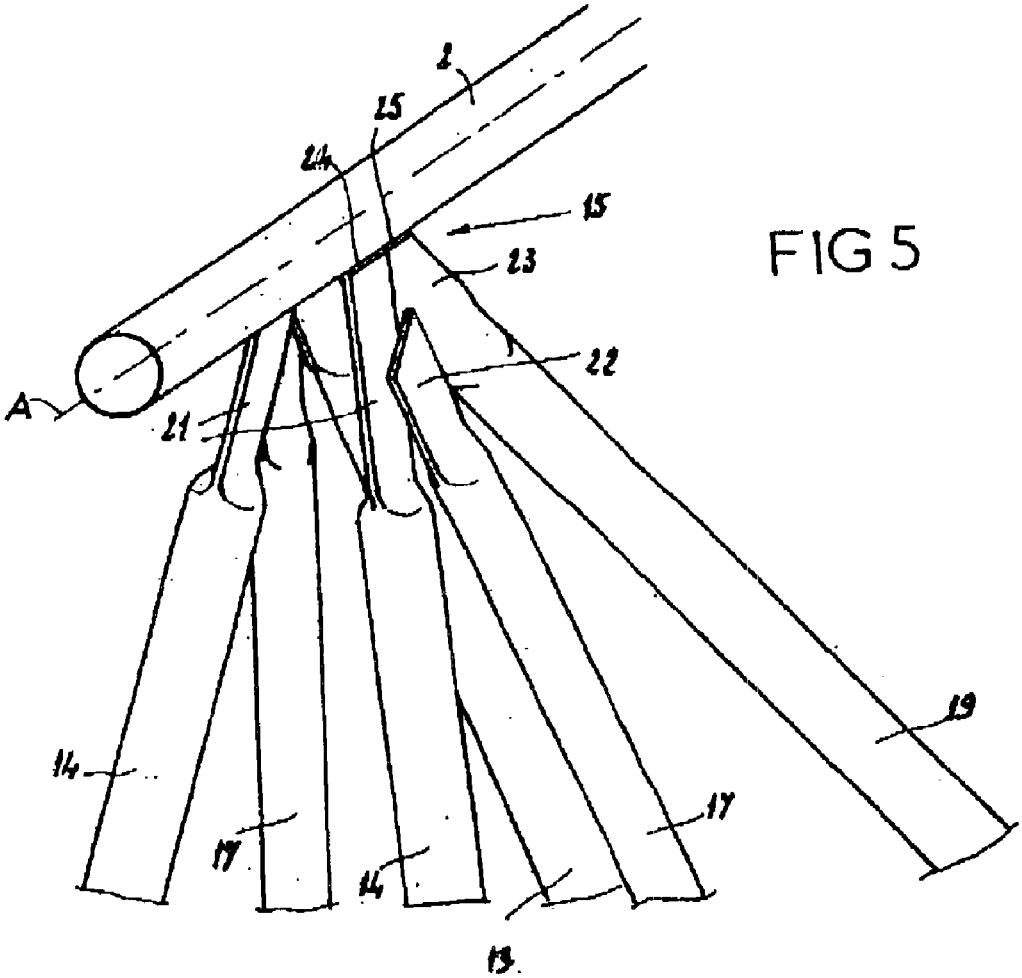
FIG. 5 is a perspective view, on a larger scale, showing a detail of an upper assembly node of the triangulation according to the invention.

Referring to the following FIGS. 5, 6 and 7, details of the lateral triangulation, which relate particularly to the upper assembly node 15, will now be described with regard to a preferred embodiment.

The various types of bars 14, 17 and 19 all consist of tubes of circular cross section, the ends of which are flattened and are cut according to a suitable contour for producing the assembly nodes. In particular, the upper ends of the compression bars 14, of the oblique tension bars 17 of smaller length and of the oblique tension bars 19 of greater length are flattened and cut ends, designated respectively by 21, 22 and 23, suitable for producing the upper assembly nodes 15.

The flattened upper end 21 of each compression bar 14, said end having a general shape of rectangular or parallelogram form, possesses, in particular, a rectilinear upper edge 24 parallel to the longitudinal axis A of the upper chord 2, here tubular. This edge 24 is welded to the upper chord 2 along a generatrix of this chord 2.

The flattened upper end 23 of each oblique tension bar 19 of greater length has a pentagonal general shape and possesses, in particular, a rectilinear upper edge 25 and a rectilinear front edge 26. The upper edge 25, parallel to the longitudinal axis A of the upper chord 2, is welded to this chord 2 along a generatrix of the latter, in the extension of the welding bead of the upper edge 24 of the flattened upper end of the compression bar 14. The substantially vertical rear edge 26 takes its place against the front edge 27 of the flattened upper end 21 of the compression bar 14. The two adjacent edges 26 and 27 are welded to one another.

The flattened upper end 22 of each oblique tension bar 17 of smaller length, which has a rectangular general shape, is applied externally against the flattened upper ends 21 and 23 to adjacent a compression bar 14 and to an oblique tension bar 19 of greater length, so as to straddle these two flattened ends 21 and 23. The perimeter 28 of the flattened upper end 22 of the oblique tension bar 17 is welded to the flattened ends 21 and 23 of the other bars 14 and 19.

Figure 6:
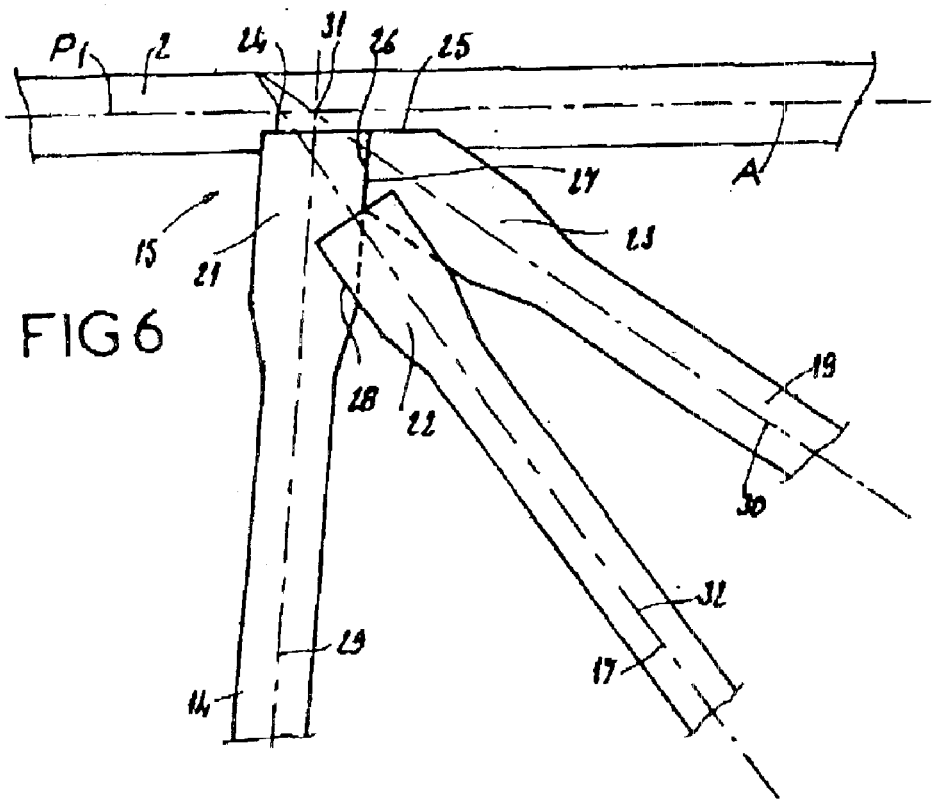
FIG. 6 is a side view of this assembly node.
Figure 7:
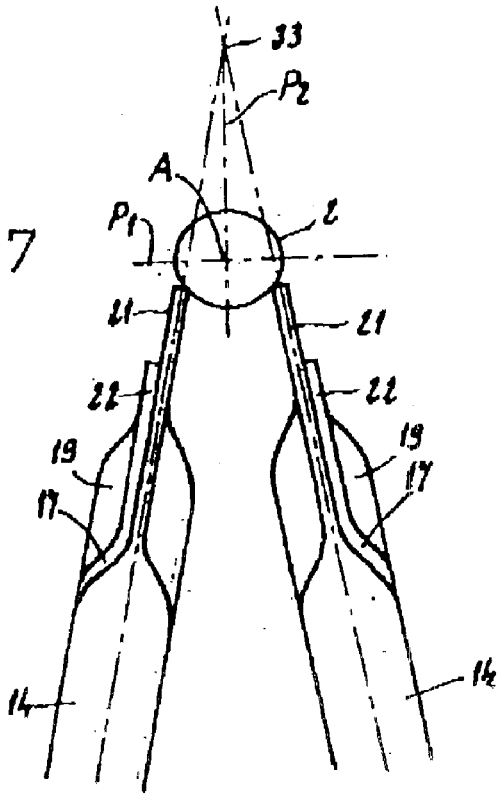
FIG. 7 is a cross-sectional view of the upper part of the jib element with triangulation according to the invention.

Finally, referring to FIGS. 6 and 7, additional particulars are given with regard to the neutral fibers of the various bars 14, 17, 19 of the lateral triangulation of the jib element 13.

The neutral fiber 29 of a compression bar 14 and the neutral fiber 30 of the oblique tension bar 19 of greater length which is associated with it are considered first, in each lateral face of the jib element 13. The two neutral fibers 29 and 30 are concurrent with one another at a point 31 located in a horizontal plane P1 which contains the neutral fiber of the upper chord 2, said neutral fiber coinciding here with the longitudinal axis A of this upper chord 2.

Now considering the symmetrical bars belonging respectively to the two lateral faces of the jib element 13, the respective neutral fibers 29, 30 of the compression bars 14 and of the oblique tension bars 19 of greater length are all concurrent with one another at points 33 located in the vertical plane P2 containing the neutral fiber (axis A) of the upper chord 2. Similarly, the respective neutral fibers 32 of the oblique tension bars 17 of staller length, belonging to the two lateral faces of the jib element 13, are concurrent at points located in the vertical plane P2 containing the neutral fiber (axis A) of the upper chord 2.

It was shown, by calculation, that the lateral triangulation described above affords an advantageous solution in terms of lightening, particularly for jib elements of relatively great height, for example for jib elements of a height greater than approximately one meter.

As a consequence of the foregoing, the lateral triangulation which is the subject of the invention can be used, in particular, for producing the jib of a tower crane without a mast head, although this does not preclude its use for tower cranes with a mast head having the function of a jib holder, in particular for the cantilevered parts of the crane jibs with a jib holder.

There would be no departure from the scope of the invention, as defined in the accompanying claims, by producing the triangulation by means of bars of any type, for example tubular bars of oval or rectangular cross section or angle pieces or else flat bars, it being possible for these bars to have a constant cross section or a cross section which is variable over their length;

modifying structural details, such as those of the upper assembly node;

carrying out dimensional modifications, for example by advancing or backing up the position of the upper assembly node;

modifying the positions of the points of concurrence of the neutral fibers;

using the same triangulation for the lateral faces of jib elements having a cross section other than triangular, for example a rectangular or trapezoidal cross section;

using this triangulation for counterjib elements for a tower crane or else for other lattice girders or lattice girder elements.

What is claimed is:

1. A lattice girder of a tower crane comprising a lateral face defined by an upper chord and a lower chord and divided longitudinally according to a predefined interval, the lattice girder further comprising:

compression bars substantially perpendicular to the upper chord and the lower chord and connecting the upper chord to the lower chord with a space between the compression bars equal to substantially double the predefined interval;

first oblique tension bars each connecting to a top of at least one of the compression bars and connecting to the lower chord at a point defined by a distance substantially equal to the predefined interval;

second oblique tension bars, each connecting to the top of the at least one of the compression bars and connecting to the lower chord at a point defined by a distance substantially equal to double the predefined interval, wherein the first oblique tension bars have a length smaller than a length of the second oblique tension bars.

2. The lattice girder of claim 1, wherein the compression bars, the first oblique tension bars and the second oblique tension bars are each in a form of a tube having a circular or oval cross section, with flattened and cut ends, wherein the flattened and cut ends form assembly nodes.

3. The lattice girder of claim 2, wherein to produce the upper assembly nodes the compression bars having the flattened and cut upper end, further have a rectilinear upper edge parallel to a longitudinal axis of the upper chord, and are welded to this upper chord;

the second oblique tension bars have a rectilinear upper edge parallel to the longitudinal axis of the upper chord, and are welded to this upper chord, the flattened and cut upper end of the second oblique tension bars also have a substantially vertical rear edge against a corresponding front edge of the flattened upper end of the compression bars, wherein the substantially vertical rear edge and corresponding front edge of the flattened upper end of the compression bars are welded to one another;

the flattened and cut upper end of the first oblique tension bars straddle the adjacent flattened upper ends of the compression bars and the second oblique tension bars the perimeter of the flattened upper end of the second oblique bars are welded to the flattened upper ends of the compression bars which the first oblique tension bars straddle.

4. The lattice girder of claim 1, wherein respective center axes of each of the compression bars and of each of the second oblique tension bars are concurrent with one another at points located along a center axis in a horizontal plane of the upper chord.

5. The lattice girder of claim 4, wherein the lattice girder has a triangular cross section and the center axes of the compression bars and of the second oblique tension bars, belonging to the two lateral faces,are all concurrent with one another at points located along a center axis in a vertical plane of the upper chord.

6. The lattice girder of claim 5, wherein respective center axes of the first oblique tension bars belonging to the two lateral faces, are themselves concurrent at the points located along the center axis in the vertical plane of the upper chord.

7. The lattice girder of claim 2, wherein respective center axes of the compression bars and of the second oblique tension bars are concurrent with one another at points located along a center axis in a horizontal plane of the upper chord.

8. The lattice girder of claim 3, wherein respective center axes of the compression bars and of the second oblique tension bars are concurrent with one another at points located along a center axis in a horizontal plane of the upper chord.

9. The lattice girder of claim 1, wherein the compression bars, the first oblique tension bars and the second oblique tensions bars are located in a plane of the lateral face.

* * * * *